US008632684B2

(12) United States Patent
Danov et al.

(10) Patent No.: US 8,632,684 B2
(45) Date of Patent: Jan. 21, 2014

(54) DEVICE FOR SEPARATING FERROMAGNETIC PARTICLES FROM A SUSPENSION

(75) Inventors: Vladimir Danov, Erlangen (DE); Bernd Gromoll, Baiersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 314 days.

(21) Appl. No.: 13/128,490

(22) PCT Filed: Sep. 25, 2009

(86) PCT No.: PCT/EP2009/062412

§ 371 (c)(1),
(2), (4) Date: May 10, 2011

(87) PCT Pub. No.: WO2010/054885

PCT Pub. Date: May 20, 2010

(65) Prior Publication Data

US 2011/0220580 A1 Sep. 15, 2011

(30) Foreign Application Priority Data

Nov. 13, 2008 (DE) ..... 10 2008 057 082

(51) Int. Cl.
*B03C 1/02* (2006.01)
*B03C 1/28* (2006.01)

(52) U.S. Cl.
USPC ..... 210/695; 210/222; 209/223.1; 209/232

(58) Field of Classification Search
USPC ..... 210/222, 695; 209/223.1, 232
See application file for complete search history.

(56) References Cited

U.S. PATENT DOCUMENTS

| | | | | |
|---|---|---|---|---|
| 4,478,711 | A | 10/1984 | Cohen et al. | 209/39 |
| 4,921,597 | A | 5/1990 | Lurie | 209/223.2 |
| 6,120,735 | A | 9/2000 | Zborowski et al. | 422/73 |
| 2005/0178701 | A1 | 8/2005 | Roth et al. | 209/636 |
| 2007/0000814 | A1 | 1/2007 | Kennedy et al. | 209/210 |

FOREIGN PATENT DOCUMENTS

| | | | | |
|---|---|---|---|---|
| DE | 2651137 | | 5/1977 | B03C 1/10 |
| DE | 3038426 | A1 | 4/1981 | |
| DE | 102004040785 | A1 | 3/2006 | B01L 3/00 |
| DE | 271116 | A | 3/2013 | |
| EP | 1913991 | A1 | 4/2008 | B01D 43/00 |
| GB | 1322229 | A | 7/1973 | |
| RU | 2006256 | C1 | 1/1994 | B01D 35/06 |
| RU | 2276259 | C2 | 5/2006 | E21B 37/00 |

(Continued)

OTHER PUBLICATIONS

The International Preliminary Report on Patentability for PCT/EP2009/062412, Issued May 17, 2011.*

(Continued)

*Primary Examiner* — David A Reifsnyder
(74) *Attorney, Agent, or Firm* — King & Spalding L.L.P.

(57) ABSTRACT

A device for separating ferromagnetic particles from a suspension has a reactor (2) through which the suspension can flow, with at least one magnet (3, 4) arranged on the outside of the reactor (2), wherein the reactor (2) has an interior space (7) and an exterior space (8) surrounding the former, wherein the interior space (7) and exterior space (8) are separated from one another by an insert (6), and the insert (6) has at least one opening (9, 10) near the at least one magnet (3, 4).

18 Claims, 1 Drawing Sheet

(56) References Cited

FOREIGN PATENT DOCUMENTS

| | | | | |
|---|---|---|---|---|
| SU | 984492 | A1 | 12/1982 | ..... B01D 35/06 |
| SU | 1655911 | A1 | 6/1991 | ..... C02F 1/48 |
| WO | 02/07889 | A2 | 1/2002 | ..... B03C 1/28 |
| WO | 03/046507 | A2 | 6/2003 | |
| WO | 2008/133726 | A2 | 11/2008 | ..... B03C 1/28 |

OTHER PUBLICATIONS

International PCT Search Report, PCT/EP2009/062412, 12 pages, Jan. 18, 2010.

* cited by examiner

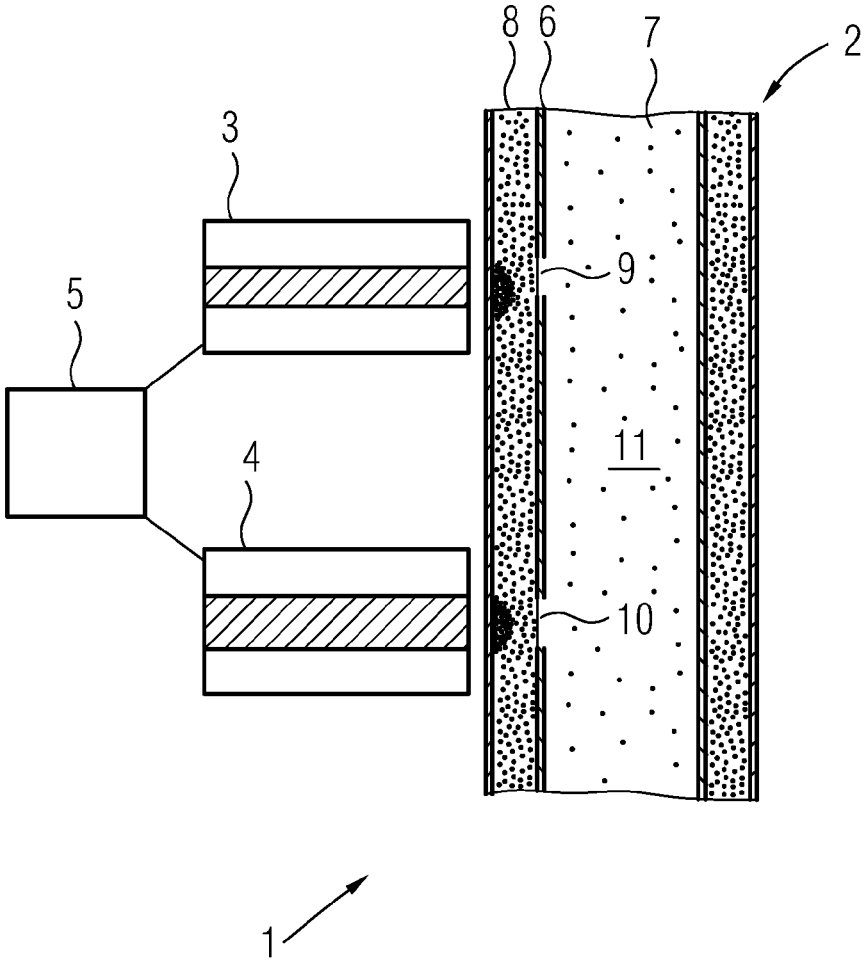
8
6
7
2
3
9
5
11
4
10
1

DEVICE FOR SEPARATING FERROMAGNETIC PARTICLES FROM A SUSPENSION

CROSS-REFERENCE TO RELATED APPLICATIONS

This application is a U.S. National Stage Application of International Application No. PCT/EP2009/062412 filed Sep. 25, 2009, which designates the United States of America, and claims priority to German Application No. 10 2008 057 082.6 filed Nov. 13, 2008. The contents of which are hereby incorporated by reference in their entirety.

TECHNICAL FIELD

The invention relates to a device for separating ferromagnetic particles from a suspension, having a reactor through which the suspension can flow, with at least one magnet arranged on the outside of the reactor.

BACKGROUND

In order to extract ferromagnetic components which are contained in ores, the ore is ground into a powder and the powder obtained is mixed with water. A magnetic field generated by one or more magnets is applied to this suspension, as a result of which the ferromagnetic particles are attracted so that they can be separated from the suspension.

DE 27 11 16 A discloses a device for separating ferromagnetic particles from a suspension, in which a drum consisting of iron rods is used. The iron rods are alternately magnetized during the rotation of the drum, so that the ferromagnetic particles adhere to the iron rods while other components of the suspension fall down between the iron rods.

DE 26 51 137 A1 discloses a device for separating magnetic particles from an ore material, in which the suspension is fed through a tube which is surrounded by a magnetic coil. The ferromagnetic particles accumulate at the edge of the tube, while other particles are separated through a central tube which is located inside the tube.

A magnetic separator is described in U.S. Pat. No. 4,921,597 B. The magnetic separator comprises a drum, on which a multiplicity of magnets are arranged. The drum is rotated oppositely to the flow direction of the suspension, so that ferromagnetic particles adhere to the drum and are separated from the suspension.

A method for the continuous magnetic separation of suspensions is known from WO 02/07889 A2. This uses a rotatable drum in which a permanent magnet is fastened, in order to separate ferromagnetic particles from the suspension.

In known devices, a tubular reactor, through which the suspension flows, is used to separate the ferromagnetic particles from the suspension. One or more magnets are arranged on the outer wall of the reactor and attract the ferromagnetic particles contained in it. Under the effect of the magnetic field generated by the magnets, the ferromagnetic particles migrate onto the reactor wall and are held by the magnet arranged on the outside of the reactor. Although this allows effective separation, the separation method can however only be carried out discontinuously since after a particular quantity of the ferromagnetic particles have accumulated, the reactor has to be opened and the ferromagnetic particles removed. Only then is it possible for a new suspension to be supplied, or for the suspension already used once to be subjected to the separation method again.

SUMMARY

According to various embodiments, a device for separating ferromagnetic particles from a suspension can be provided, with which the separation method can be carried out continuously and efficiently.

According to an embodiment, in a device for separating ferromagnetic particles from a suspension, having a reactor through which the suspension can flow, with at least one magnet arranged on the outside of the reactor, the reactor has an inner space and an outer space surrounding the inner space, the inner space and the outer space being separated from one another by an insert, and the insert having at least one opening in the vicinity of the at least one magnet.

According to a further embodiment, the inner space may have a circular cross section and the outer space has an annular cross section. According to a further embodiment, the insert may have a multiplicity of openings which are separated from one another in the flow direction. According to a further embodiment, the insert may have a multiplicity of openings which are separated from one another in the circumferential direction and to which the at least one magnet is respectively assigned. According to a further embodiment, the at least one magnet can be formed as an electromagnet, which can preferably be switched on and off. According to a further embodiment, the strength of the magnetic field generated by the electromagnet can be controllable. According to a further embodiment, the diameters of the inner space and outer space and the flow rate of the suspension can be selected so that virtually no transverse flow takes place between the inner space and the outer space. According to a further embodiment, the device may comprise a controller for switching the flow on or off in the outer space and/or the inner space.

BRIEF DESCRIPTION OF THE DRAWINGS

Other advantages and details will be explained with the aid of an exemplary embodiment with reference to the FIGURE.

The FIGURE is a schematic representation and shows a section through a device according to various embodiments for separating ferromagnetic particles from a suspension.

DETAILED DESCRIPTION

According to various embodiments, a device of the type mentioned in the introduction is provided, in which the reactor has an inner space and an outer space surrounding the inner space, the inner space and the outer space being separated from one another by an insert, and the insert having at least one opening in the vicinity of the at least one magnet. The device according to various embodiments has the advantage that it can be operated continuously. The suspension flows through the inner space, and ferromagnetic particles contained in the suspension experience the effect of the magnetic field generated by the at least one magnet and are attracted by it. The ferromagnetic particles pass through the at least one opening in the inner space and accumulate in the outer space, preferably on the inner wall of the reactor. The ferromagnetic particles separated in this way from the suspension flowing through the inner space can subsequently be removed comparatively easily.

The inner space of the device according to various embodiments may have a circular cross section and for the outer space to have an annular cross section. The insert may accordingly be formed with a tubular shape, the outer space being bounded by an exterior tube.

In order to increase the efficiency of the separation, the insert may have a multiplicity of openings which are separated from one another in the flow direction. When the suspension flows through the inner space, ferromagnetic particles are gradually separated from the suspension so that the concentration of ferromagnetic particles in the outer space increases progressively.

As an alternative or in addition, the insert may have a multiplicity of openings which are separated from one another in the circumferential direction and a multiplicity of magnets. Each opening in the insert may in this case be assigned a magnet, so that the ferromagnetic particles move radially from the inner space to the outer space.

According to an embodiment, at least one magnet may be formed as an electromagnet which can preferably be switched on and off. If an electromagnet or a multiplicity of electromagnets are provided, these can be switched on and off in a controlled way. When the electromagnet is switched off, the magnetic field collapses so that the ferromagnetic particles adhering to the inner wall of the outer space are entrained by the flow. In this state, the suspension contained in the outer space can be removed so that the desired separation of the ferromagnetic particles from the suspension is achieved. The electromagnets can subsequently be switched on again so that the ferromagnetic particles once more flow from the inner space into the outer space, where they adhere to the inner wall of the reactor. The movement of the ferromagnetic particles in the device according to various embodiments may also be controlled in that the strength of the magnetic field generated by the at least one electromagnet is controllable.

According to various embodiments, the diameters of the inner space and outer space and the flow rate of the suspension may be selected so that virtually no transverse flow takes place between the inner space and the outer space. This is necessary in order for no pressure loss, or only a small pressure loss, to occur between the inner space and the outer space, as a result of which an undesired transverse flow is avoided so that only the ferromagnetic particles flow from the outer space into the inner space under the effect of the magnetic field.

According to an embodiment, a controller may be provided for switching the flow on or off in the outer space and/or the inner space. In order to separate the ferromagnetic particles which have accumulated in the outer space, the flow in the outer space may be switched on while the flow is switched off in the inner space. Conversely, merely the flow in the inner space may be switched on so that ferromagnetic particles migrate under the effect of the magnetic field into the outer space, in which no flow takes place. It is also possible for the flow in the outer space to be switched on at intervals or intermittently The device 1 comprises a reactor 2, on the outside of which magnets 3, 4 are arranged. These are electromagnets, which can be switched on and off by means of a controller 5.

The reactor 2 comprises an insert 6, which in the exemplary embodiment represented is formed with a tubular shape. The reactor 2 is likewise formed with a tubular or cylindrical shape. The insert 6 in the reactor 2 separates an inner space inside the insert 6 from an outer space 8, which has an annular cross section and is bounded by the outer wall of the reactor 2.

The insert 6 has a plurality of openings 9, 10, which are separated from one another and by which the inner space 7 is connected to the outer space 8. The opening 9 lies in the vicinity of the magnet 3, and the opening 10 lies in the vicinity of the magnet 4. In other embodiments, further openings may be provided which are arranged either distributed over the circumference of the insert 6 and/or distributed in the longitudinal direction of the insert 6, i.e. in the flow direction. Each of these further openings may be assigned a magnet.

The device shown in the FIGURE makes it possible to separate ferromagnetic particles from a suspension. The inner space 7 of the reactor 2 is filled via a line (not shown) with the suspension 11, and the suspension 11 flows continuously through it. When the magnets 3, 4 are switched on by the controller 5, ferromagnetic particles contained in the suspension 11 are deflected radially from the flow under the effect of the magnetic field generated by the magnets 3, 4. The ferromagnetic particles pass through the openings 9, 10 and enter the outer space 8 of the reactor 2, where they accumulate on the inner wall as shown in the FIGURE. The suspension 11 may likewise flow through the outer space 8, although it is also conceivable to let the suspension 11 flow only through the inner space 7 so that the ferromagnetic particles gradually accumulate in the outer space 8. The flow rate in the inner space 7 is in this case adapted to the geometrical parameters of the reactor and in particular to the size and number of the openings 9, 10, in such a way that virtually no pressure loss occurs between the inner space 7 and the outer space 8, so that no transverse flow takes place through the openings 9, 10 and only the ferromagnetic particles migrate from the inner space 7 into the outer space 8 under the effect of the magnetic field.

When the magnets 3, 4 are switched off by means of the controller 5 or manually, the magnetic particles adhering to the inner wall of the reactor 2 are released and can be entrained by the flow and removed. Separation of the removed ferromagnetic particles from the remaining suspension can subsequently be carried out easily using a screen or the like.

The controller 5 may also be used to control the strength of the magnetic field generated by the magnets 3, 4. The magnetic field may be controlled in such a way that it is switched on and off at intervals or intermittently, so that the ferromagnetic particles adhering to the inner wall of the reactor 2 are automatically removed after a certain time. The controller is also capable of switching the flow through the inner space 7 (primary flow) or the flow in the outer space 8 (secondary flow) on or off, so that for example the outer space 8 can be flushed in a controlled way. Continuous operation and continuous separation of the ferromagnetic particles are possible with the device shown in the FIGURE, without the primary flow having to be interrupted.

What is claimed is:

1. A device for separating ferromagnetic particles from a suspension, comprising:

a reactor through which the suspension can flow along an axial direction; wherein the reactor includes an inner space and an outer space surrounding the inner space in a transverse direction; an insert separating the inner space of the reactor from the outer space of the reactor, the insert having at least one transverse opening; and at least one magnet disposed on an exterior of the reactor in the vicinity of the at least one transverse opening in the insert.

2. The device according to claim 1, wherein the inner space has a circular cross section and the outer space has an annular cross section.

3. The device according to claim 1, wherein the insert has a multiplicity of openings which are separated from one another in the flow direction.

4. The device according to claim 1, wherein the insert has a multiplicity of openings which are separated from one another along a perimeter of the insert and to each of which at least one magnet is respectively assigned.

5. The device according to claim 1, wherein the at least one magnet comprises an electromagnet.

6. The device according to claim 5, wherein the strength of the magnetic field generated by the electromagnet is controllable.

7. The device according to claim 5, wherein the at least one electromagnet can be switched on and off.

8. The device according to claim 1, wherein the diameters of the inner space and outer space and the flow rate of the suspension are selected so that virtually no transverse flow takes place between the inner space and the outer space.

9. The device according to claim 1, wherein it comprises a controller for switching the flow on or off in at least one of the outer space and the inner space.

10. A method for separating ferromagnetic particles from a suspension, using a reactor through which the suspension can flow, with at least one magnet disposed on an exterior of the reactor, comprising:

feeding the suspension to an interior of the reactor, wherein the interior of the reactor includes an inner space and an outer space surrounding the inner space in a transverse direction, and an insert separating the inner space from the outer space, and the insert having at least one transverse opening in the vicinity of the at least one magnet; and applying a magnetic field with the at least one magnet as the suspension flows through the reactor in an axial direction.

11. The method according to claim 10, wherein the inner space has a circular cross section and the outer space has an annular cross section.

12. The method according to claim 10, wherein the insert has a multiplicity of openings which are separated from one another in the flow direction.

13. The method according to claim 10, wherein the insert has a multiplicity of openings which are separated from one another around a perimeter of the insert and to each of which at least one magnet is respectively assigned.

14. The method according to claim 10, wherein the at least one magnet comprises an electromagnet.

15. The method according to claim 10, further comprising switching the at least one magnet on and off.

16. The method according to claim 10, further comprising controlling the strength of the magnetic field generated by the at least one magnet.

17. The method according to claim 10, further comprising selecting the diameters of the inner space and outer space and the flow rate of the suspension so that virtually no transverse flow takes place between the inner space and the outer space.

18. The method according to claim 10, further comprising switching the flow on or off in at least one of the outer space and the inner space by means of a controller.

* * * * *